United States Patent [19]

Bingham

[11] Patent Number: 4,463,805

[45] Date of Patent: Aug. 7, 1984

[54] METHOD FOR TERTIARY RECOVERY OF OIL

[76] Inventor: Clark Bingham, 4220 S.W. 75th Ave., Portland, Oreg. 97225

[21] Appl. No.: 425,541

[22] Filed: Sep. 28, 1982

[51] Int. Cl.[3] ..... E21B 36/04; E21B 43/24

[52] U.S. Cl. ..... 166/248; 166/60; 166/302

[58] Field of Search ..... 166/248, 60, 65 R, 302

[56] References Cited

U.S. PATENT DOCUMENTS

| | | | |
|---|---|---|---|
| 2,799,641 | 7/1957 | Bell | 166/248 X |
| 3,507,330 | 4/1970 | Gill | 166/248 |
| 3,547,193 | 12/1970 | Gill | 166/248 |
| 3,605,888 | 9/1971 | Crowson et al. | 166/248 |
| 3,620,300 | 11/1971 | Crowson | 166/248 |
| 3,642,066 | 2/1972 | Gill | 166/248 |
| 3,782,465 | 1/1974 | Bell et al. | 166/248 |
| 4,010,799 | 3/1977 | Kern et al. | 166/248 |
| 4,037,655 | 7/1977 | Carpenter | 166/248 |

*Primary Examiner*—Stephen J. Novosad

*Attorney, Agent, or Firm*—Chernoff, Vilhauer, McClung, Birdwell & Stenzel

[57] ABSTRACT

A method for enhancing the recovery of oil from underground formations includes alternately using a single bore hole as an electrode well and a producing well by placing a first electrode in electrical contact with the oil-bearing formation through the bore hole and passing electrical current through the oil-bearing formation which has been infused with an aqueous electrolytic liquid to a second larger electrode in electrical contact with earth material, and creating sufficient heat and current density proximate the first electrode to precipitate a local exothermic electrochemical reaction producing hot gases which pressurize the formation, thin the oil and break the oil out of the formation matrix. After the formation has been adequately conditioned by the reaction, oil is produced from the bore hole where the beneficial aspects of the reaction are greatest. Preferably, the electrical current employed is alternating current having a substantially rectangular waveform.

35 Claims, 6 Drawing Figures

METHOD FOR TERTIARY RECOVERY OF OIL

BACKGROUND OF THE INVENTION

This invention relates to a method for enhancing oil production from an oil or hydrocarbon-bearing formation by increasing the temperature and pressure of the formation, and more particularly to an economical method for creating a region of electrical current density within the formation sufficient to cause an exothermic electrochemical reaction between water and oil in the formation.

Dwindling oil supplies and the resultant rise in oil prices coupled with a national desire to become increasingly energy independent has placed added emphasis on improved secondary and tertiary recovery methods for known oil reserves. Much of these known reserves are presently economically unrecoverable because the oil is of high viscosity and/or high specific gravity or is locked within the formation matrix and will not flow within the formation toward the producing well, or there is little or no pressure in the oil-bearing formation to help lift the oil to the surface. Consequently, most secondary and tertiary recovery methods use techniques to increase the temperature and/or pressure of the oil-bearing formation to reduce the viscosity of the oil in the formation and encourage the oil to flow toward a producing well. For example, "fire flooding" employs the technique of burning the oil "in situ" or within the formation, thereby heating the formation and pressurizing the formation with the resultant hot combustion gases. However, fire flooding has significant disadvantages in that it contaminates the oil-bearing formation with combustion byproducts and requires expensive equipment to maintain and control the fire front within the subsurface formation.

Other thermally-oriented techniques of increasing the pressure and temperature of subsurface oil-bearing formations include flooding the formation with hot water or steam. This may be accomplished by injecting steam or hot water down a bore hole from a surface installation or may be accomplished "down-hole" by introducing electrical current into the oil-bearing formation and using the principle of resistive heating to create thermal energy by passing the current through an aqueous electrolytic liquid such as saltwater located within the oil-bearing formation. Of course, hot water flood pressurizes the formation substantially only to the extent of the added mass of water or steam, and heats the formations only in proportion to the amount of thermal energy which has been obtained from an outside source, such as a source of electrical power which heats the water or steam by down-hole resistive heating. Steam flood is more efficient at heating a larger area of the formation since the gaseous steam dissipates more easily throughout the formation, but its long-term pressurization effect is similarly limited to the volume of the water to which the steam condenses as it cools. Prior art patents such as U.S. Pat. Nos. 3,507,330, 3,547,193, 3,605,888, 3,620,300 and 3,642,066 exemplify down-hole electro-thermal techniques to heat and pressurize the oil-bearing formation.

Carbon dioxide flood is a tertiary recovery method employing the principles of pressurization of the formation and thinning of the oil to enhance oil recovery. $CO_2$ is injected under pressure into the formation generally in combination with water. Under relatively low formation pressures, the $CO_2$ remains in its gaseous state and pressurizes the formation according to the volume of gas and water injected. Under higher formation pressures, the $CO_2$ goes into solution with the formation oil, increasing the actual volume of the oil while reducing its specific gravity and viscosity and thereby pressurizing the formation and thinning the oil. An additional benefit of $CO_2$ flood is that when the $CO_2$ goes into solution with the formation oil and the volume of the oil is thereby increased, this increase in volume causes the oil to "break out" of the formation matrix allowing the oil to flow toward the producing well.

Other methods for enhancing oil recovery which involve introducing electric current into the oil-bearing formation employ the principles of electroosmosis, exemplified by U.S. Pat. Nos. 2,799,641, 3,642,066 and 3,782,465. Electroosmosis generally involves passing a unidirectional (DC) current through the oil-bearing formation between two bore holes, the current imposing an electromotive force on the oil and connate saltwater in the formation tending to move the oil toward the cathode well. Electroosmosis may be used in combination with an electro-thermal method.

Another secondary method of oil recovery which introduces electric current into the oil-bearing formation is taught by Carpenter U.S. Pat. No. 4,037,655. Carpenter discloses a method of pressurizing an oil-bearing formation by passing AC current through the formation between spaced-apart electrode bore holes which penetrate the formation and thereby causing an electro-chemical reaction which generates volumes of free hydrogen within the formation driving the oil toward producing bore holes which are remote from the electrode bore holes. Carpenter teaches establishing a relatively large zone of electro-chemical activity in the oil-bearing formation, said zone being defined by the electric field between the two spaced apart electrode bore holes and using the gas produced by this electrochemical reaction to pressurize the formation and drive the formation oil to a producing bore hole which is remote from the zone of electro-chemical activity.

While the aforementioned electrically related oil recovery techniques may effectively enhance secondary and tertiary oil recovery they are not particularly efficient or economical, chiefly because of the significant expense of the large amounts of electricity required to practice such techniques. Methods employing unidirectional current (DC) have the added problem of accelerated erosion of the electrodes due to electrolysis. Even the technique taught by the aforementioned Carpenter patent, which unlike the down-hole resistance heating methods probably obtains some heating energy from an electrochemical reaction, is inefficient because the temperaure and pressure are applied to push oil toward a remote bore hole rather than produce oil locally, and the heating and thinning effects which might otherwise be obtained are thereby largely wasted. In many cases the oil is just too viscous to be moved within the formation or pumped to the surface without the thinning effect of localized heat in addition to the increased formation pressure.

Moreover, a technique such as Carpenter's which requires a plurality of operational bore holes necessitates either the considerable expense of drilling and casing additional multiple bore holes which are not to be used for oil production, or the inconvenience of being able to practice such a technique only where there is a plurality of preexisting bore holes in reasonable proximity to each other. Passing electrical current through the formation between such spaced-apart bore holes as disclosed by several of the aforementioned patents also necessitates above-ground electrical transmission lines with the resultant expense.

SUMMARY OF THE INVENTION

According to the present invention, an improved method for secondary recovery of oil alternately uses a single bore hole first as an electrode well and then as a producing well. A first, relatively small electrode is placed through the bore hole into electrical contact with the oil-bearing formation. Saltwater or other aqueous electrolytic liquid is injected under pressure through the bore hole into the formation proximate the small electrode and the bore hole is sealed from atmospheric pressure. Electrical current is passed from the small electrode through the saltwater-infused oil-bearing formation to a second relatively large electrode, such as the conductive well casing of the electrode bore hole or the conductive casing of an adjacent bore hole, which is in electrical contact with earth material other than the oil-bearing formation. The resistance of the saltwater, proximate the small electrode, to the electrical current heats the formation locally. With sufficient temperature and current density at the small electrode an exothermic electrochemical reaction between the water and oil in the formation is initiated and sustained for a first time interval, further heating the formation locally and pressurizing the entire formation with the resultant hot gases which spread out into the oil-bearing formation. In the course of the reaction, the carbon atoms of the oil combine separately with the hydrogen atoms and oxygen atoms of the water producing hot carbon dioxide and methane. Free hydrogen is also produced. Under sufficient pressure the carbon dioxide and methane will go into solution with the oil, increasing its volume and having a thinning effect.

Because the well is sealed, the pressure and temperature produced by the exothermic reaction are allowed to rise without boiling of the saltwater or burning of the oil other than to the limited extent permitted by combination with the oxygen atoms of the water. The electric current is then interrupted for a second time interval shorter than the first time interval and the temperature of the oil is allowed to sink below the flash point of oil at atmospheric pressure while the well remains sealed to retain the pressure. Of course, during this second time interval the heat is distributed into the formation and further reduces the viscosity of oil present in the formation. After this cooling period, the process may be repeated, or oil may be produced locally from the same bore hole, rather than a bore hole remote therefrom, the recovery enhanced by the retained pressurization of the oil field and the beneficial local thinning effects of the heating and dissolved gases.

For economical and efficient operation it is important that the electrode in the oil-bearing formation be sufficiently small with respect to the current to achieve the requisite current density in the saltwater-infused, oil-bearing formation proximate the electrode to trigger the exothermic electrochemical reaction. The heat produced by the exothermic electrochemical reaction is much greater than the heat which can be produced by resistive heating for a given unit of electricity, and thus provides a much greater benefit per unit of electrical power consumed. Since the reaction is triggered by a sufficient current density, alternating current having a substantially rectangular wave form is preferably employed to maximize the duty cycle of the alternating current at or above the required current density.

Accordingly it is a principal objective of the present invention to provide an improved method of secondary recovery for known oil reserves by increasing the temperature and pressure of the oil-bearing formation by means of an exothermic electrochemical reaction within the formation, and producing oil from a region of the oil-bearing formation where the beneficial effects of such an exothermic electrochemical reaction are the greatest.

It is a further object of the present invention to provide such a method which does not necessarily require multiple bore holes but, rather, can employ only one bore hole which is alternately used as an electrode well and a producing well.

It is a further object of the present invention to provide an economical and efficient method for initiating and sustaining such exothermic electrochemical reaction.

It is a related object of the present invention to provide such a method which employs alternating current having a substantially rectangular waveform to initiate and sustain such an exothermic electrochemical reaction.

It is a further object of the present invention to provide a method to enhance the economic recovery of oil in an oil-bearing formation by reducing the viscosity of the oil, increasing the volume of the oil, and breaking the oil out of its formation matrix.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
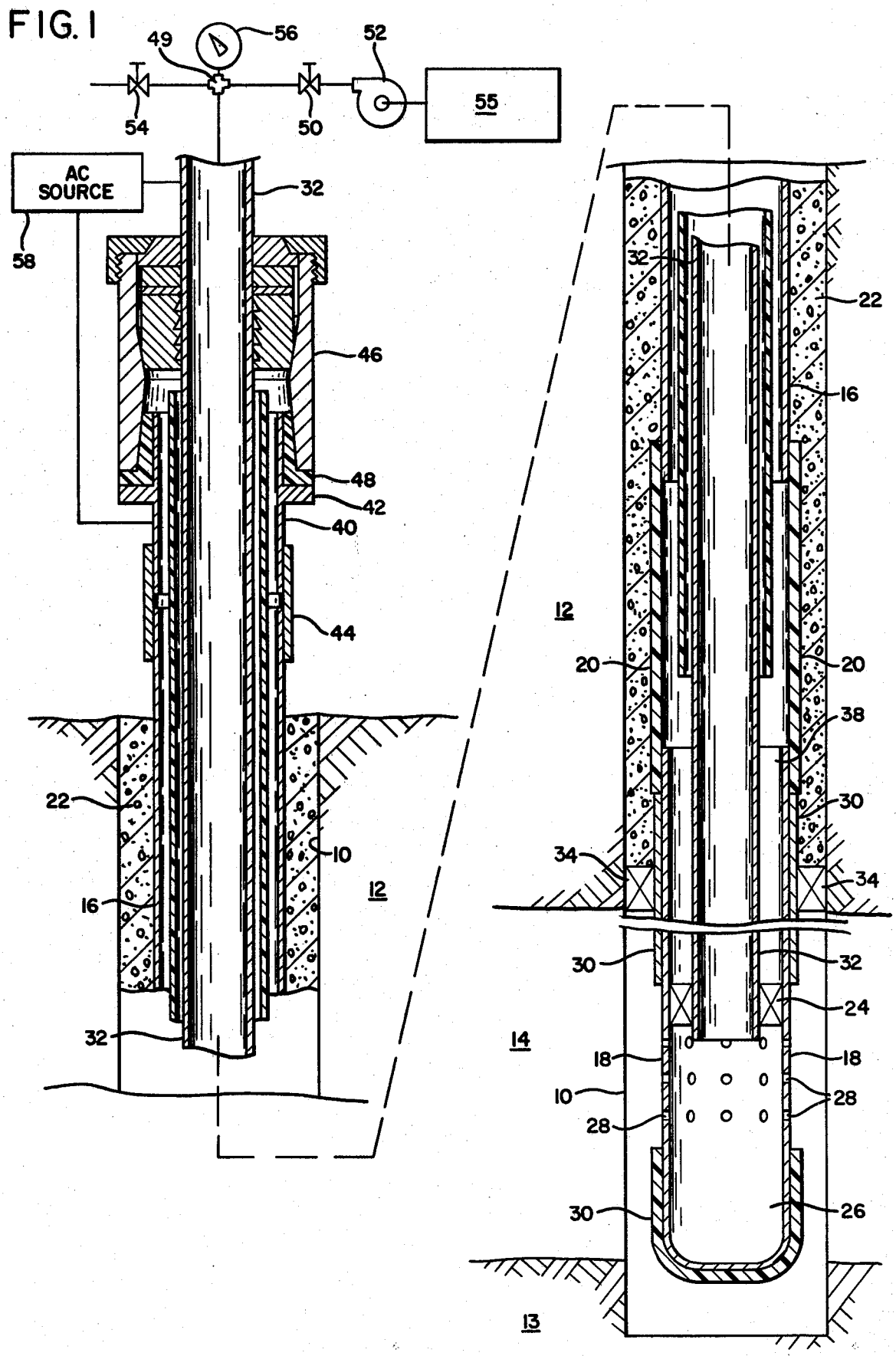
FIG. 1 is a partially schematic extended sectional view of one embodiment of the invention.

Referring to the exemplary embodiment shown in FIG. 1, a bore hole 10 is drilled through overlying earth material 12 through an oil-bearing formation 14 and into the underburden 13. The bore hole 10 is substantially lined with a string of electrically conductive wall casing 16, commonly made of steel, which has an extreme lower portion serving as the electrode 18 and an intermediate lower portion consisting of nonconductive well casing 20. The entire well casing is preferably arranged within the bore hole so that only the electrode 18 extends into the oil-bearing formation 14 and the casing is cemented into position by introducing cement 22 into the annular space between the well casing and the sides of the bore hole substantially the entire length of the casing. The cement is prevented from flowing down into the oil-bearing formation by an annular cement basket 34 positioned around the electrode 18, proximate the interface of the formation 14 and the overlying earth material 12.

The electrode 18 has a closed sump 26 and perforations 28 in the conductive well casing which comprises the electrode above the sump. The perforations 28 allow introduction of salt water or other aqueous electrolytic liquid into the formation 14 and also permit oil from the pressurized formation to enter into the casing and move to the surface. Particles such as sand, which enter the casing suspended in the oil, will drop into the sump 26 which can be periodically cleaned out.

As will be fully explaind below, it is necessary to limit the size of the electrode 18 which is in electrical contact with the oil-bearing formation. This may be accomplished by selectively applying a nonconductive coating 30 such as a ceramic material, to portions of the electrode.

A string of electrically conductive tubing 32 is positioned within the casing extending from the surface down into the oil-bearing formation, the tubing being secured to the electrode 18 by a conductive packer 24. A string of electrically nonconductive tubing 36 is positioned outside the conductive tubing 32 and inside the conductive casing 16 extending from the surface down to the section of nonconductive casing 20 to insulate the conductive tubing from the surrounding conductive casing. A nonconductive liquid such as diesel fuel 38 is injected into the annular space defined by the conductive tubing and the well casing to enhance electrical and thermal insulation of the conductive tubing from the conductive casing. The diesel fuel is prevented from escaping into the oil-bearing formation by the conductive packer 24 and because the diesel fuel, being lighter than saltwater or other aqueous formation fluids, will float within the casing on top of the pressurized formation fluids.

At the surface, a fabricated nipple 40 incorporating a flange 42 is attached to the conductive casing 16 by a casing collar 44. The nipple 40, flange 42, and casing 44 are all made of an electrically conductive material such as steel. A female well head 46, such as commonly used in the industry, is cemented to the nipple with epoxy 48 or some other non-conductive structural filler, thereby insulating the female well head which is in electrical contact with the conductive tubing 32 from the nipple 40 which is in electrical contact with the conductive casing 16.

The conductive tubing 32 is connected through one side of a T connector 49 to an injection valve 50, pump 52, and saltwater supply 55 through a nonconductive hose for injecting saltwater or other aqueous electrolytic liquid under pressure into the formation through the conductive tubing. A relatively long length of small diameter nonconductive hose is used to reduce current flow through the saltwater in the hose to the ground-potential saltwater supply. A discharge valve 54 is connected to the other side of the T connector 49 for relieving pressure in the formation proximate the bore hole and testing the crude oil produced from the oil well. A pressure gauge 56 is connected in communication with the conductive tubing 32 to monitor the formation pressure.

An AC power source 58, preferably providing alternating current having a substantially rectangular waveform, rather than the usual sinusoidal waveform, has electrical leads to the conductive tubing 32 and the conductive casing 16 of the well.

In operation, the formation is first preferably conditioned in one of the usual methods such as fracturing or acidizing to break down the formation matrix near the bore hole. Then saltwater or other suitable aqueous electrolytic liquid is preferably injected under pressure into the formation through the conductive tubing 32 and out the perforations 28 in the electrode 18. Although connate saltwater is often found in the oil-bearing formation, the pressure injection of additonal saltwater is preferable because it helps to cool the electrode, preventing a runaway increase in temperature at the electrode. The injected saltwater is also helpful to achieve the desired electrolytic resistance since varying the amount of dissolved salts in the water will vary the electrical resistivity of the saltwater.

Figure 4:
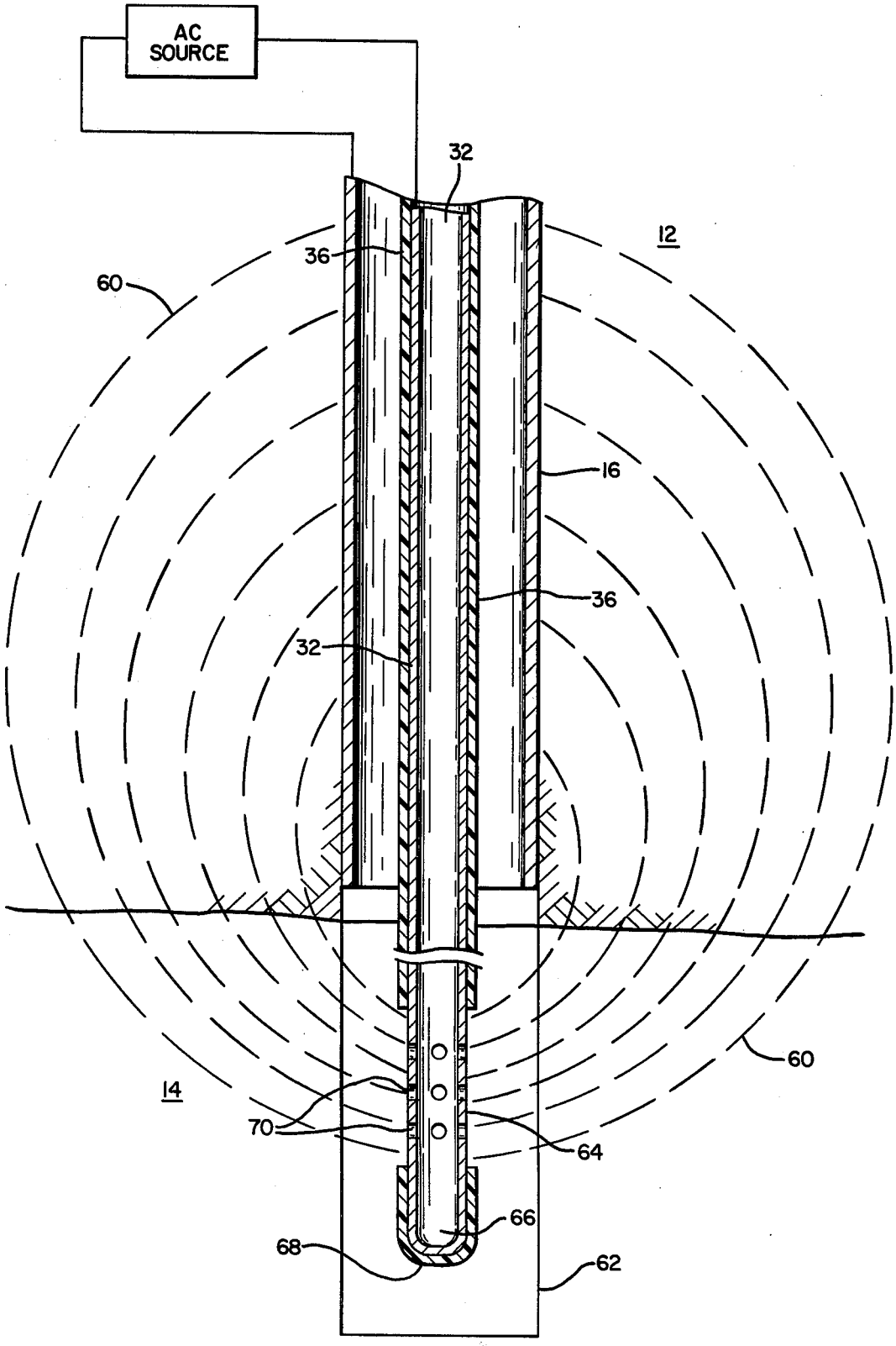
FIG. 4 is a partially schematic sectional view of a fourth embodiment of the invention.

Electrical current from the AC power source 58 is passed through the oil-bearing formation 14 and the overlying earth material 12 between the electrode 18, which is electrically connected to the conductive tubing, and the conductive well casing 16. The relatively small uncoated portion of the electrode is in electrical contact with the saltwater-infused oil-bearing formation and the relatively large conductive well casing is in electrical contact with the overlying earth material. As the current path spreads out from the electrode into the formation, the cross-section of the electrolytic conductor is effectively increased and the resistance of the electrolytic conductor is therefore decreased. Since the resistance of a conductor is generally inversely proportional to its cross-section, and the conductive tubing 32 and casing 16 are relatively low-resistance conductors due to their material, the resistance in the above-described circuit will be greatest in the saltwater-infused oil-bearing formation proximate the electrode. As a result, considerable thermal energy will be generated in this area as a function of resistive heating. It will be apparent that because of the large, electrically conductive surface area of the well casing 16 in electrical contact with the surrounding earth material, electrical resistance, and therefore heat generation and wasted energy consumption as a result thereof, will be minimal proximate the well casing. The configuration of the electrical field 60 shown in FIG. 4 illustrates this concept. The nonconductive well casing 20 interposed between the electrode 18 and the conductive casing 16 prevent a short circuit between the electrode and the conductive well casing and forces the electrical field representing the current path through the oil-bearing formation and overlying earth material. It will be appreciated however, as shown in FIG. 4, that the electrical field is most intense proximate the electrode 18 and becomes weaker as the distance from the electrode increases.

The diesel fuel 38, injected between the conductive tubing and the conductive casing, and the conductive packer 34 prevent the pressure-injected saltwater from rising inside the well casing and creating a short circuit between the electrode and the conductive well casing.

As explained above, the electrical current passing through the saltwater-infused oil-bearing formation proximate the electrode first generates heat locally due to the electrical resistance of the saltwater. The well is sealed from atmospheric pressure, allowing the pressure to build and preventing the saltwater from boiling away.

Since the resistance of an electrolytic liquid decreases as the temperature increases, the current supplied from a relatively constant-voltage source will increase as the temperature of the saltwater around the electrode increases. Allowing the temperature and current to increase proximate the relatively small electrode in the presence of oil and water will result in an exothermic, electrochemical reaction.

Under the requisite temperature and current density conditions, the bond between the hydrogen and oxygen atoms in the water molecule are weakened allowing the carbon atoms in the crude oil to combine separately with the hydrogen and oxyen to form methane and carbon dioxide. As this reaction progresses, less of the energy supplied by the applied voltage is consumed in resistive heating, being used instead to weaken the polar covalent bonds of the water molecule. The net reaction is exothermic, giving off these hot gases which spread out into the formation increasing the temperature and pressure thereof. Expressed in chemical formulae:

$$2H_2O=2H_2+O_2$$

$$C+2H_2=CH_4$$

$$C+O_2=CO_2$$

It is unlikely that free oxygen is formed in the reaction, the carbon probably reacting with the oxygen in the water while its molecular bonds are weakened by the heat and current intensity.

As the hot gases created by this reaction diffuse into the formation, heat is dissipated into the formation, reducing the viscosity of the crude oil and pressurizing the formation to the extent of the additional volume of gases. Under sufficient formation pressure, the gases, especially $CO_2$, will go into solution with the oil, further reducing its viscosity by decreasing its specific gravity and increasing its volume. The increased volume of the oil helps the oil to "break out" or become displaced from the formation matrix allowing it to flow more readily toward the well bore when the electrode well is converted into a producing well. It is to be noted that using the electrode well as a producing well is especially desirable because of the localized beneficial effects of the reaction including thermal thinning of the oil, thinning of the oil due to solution gases, and displacement of the oil from the matrix. The thinned oil will flow more readily toward the producing well, and will be easier and therefore cheaper to pump to the surface than highly viscous oil. Although these effects may occur to some degree throughout the formation, the entire formation being pressurized by this reaction, they are more intense, and hence more beneficial, near the well. Therefore, although producing out of the electrode well is preferable, it will be apparent that producing out of an adjacent bore hole sufficiently proximate to the electrode well to take advantage of the aforementioned localized effects is within the contemplation of the present invention.

Since current density is a key precipitating factor of this reaction, it should be noted that having a relatively small electrode in the oil-bearing formation is necessary for the efficient and economical practice of this invention. A large electrode may be desirable for mere hot water or steam flooding such as in the previous downhole resistance heating methods, but such a large electrode would require inefficiently large amounts of electrical power to achieve the current density necessary to trigger the desired electrochemical reaction which produces the great majority of the energy in the present invention. It also follows that the reaction is confined to an area proximate the electrode since the current density decreases approximately inversely to the square of the distance from the electrode.

Temperatures achieved at the electrode during this process will be in excess of the atmospheric boiling point of water (212° F.) and the flash point of oil (320°-360° F.). These temperatures are made possible by the existing formation pressure, injection pressure of the saltwater and the pressure due to the standing column or "head" of saltwater in the conductive tubing 32. Therefore the depth of the well is a factor in determining the achievable temperature at the electrode. A high temperature is desirable because the electrochemical reaction is more efficient at higher temperatures.

Given this background regarding temperature, pressure, and current density, an example of an installation which is capable of initiating the exothermic electrochemical reaction is: 200 psi injection pressure, 500 foot well depth, 500 square inches of electrode surface area, and 400 amps of current. Somewhat less current will be necessary to maintain the reaction after the temperature proximate the electrode builds up.

Monitoring the pressure gauge 56 will enable the practitioner to determine whether the exothermic electrochemical reaction is occurring. Rapidly decreasing pressure after interrupting the current flow indicates that the pressure increase was due to steam which dissipates out into the formation and cools to water, while a slowly decreasing pressure indicates that the reaction has produced the aforementioned gases which are pressurizing the formation. Current flow necessary to initiate the reaction may be adjusted by changing the applied voltage to changing the chemical composition and hence the resistive properties of the aqueous electrolytic liquid.

Figures 2, 5, 6:
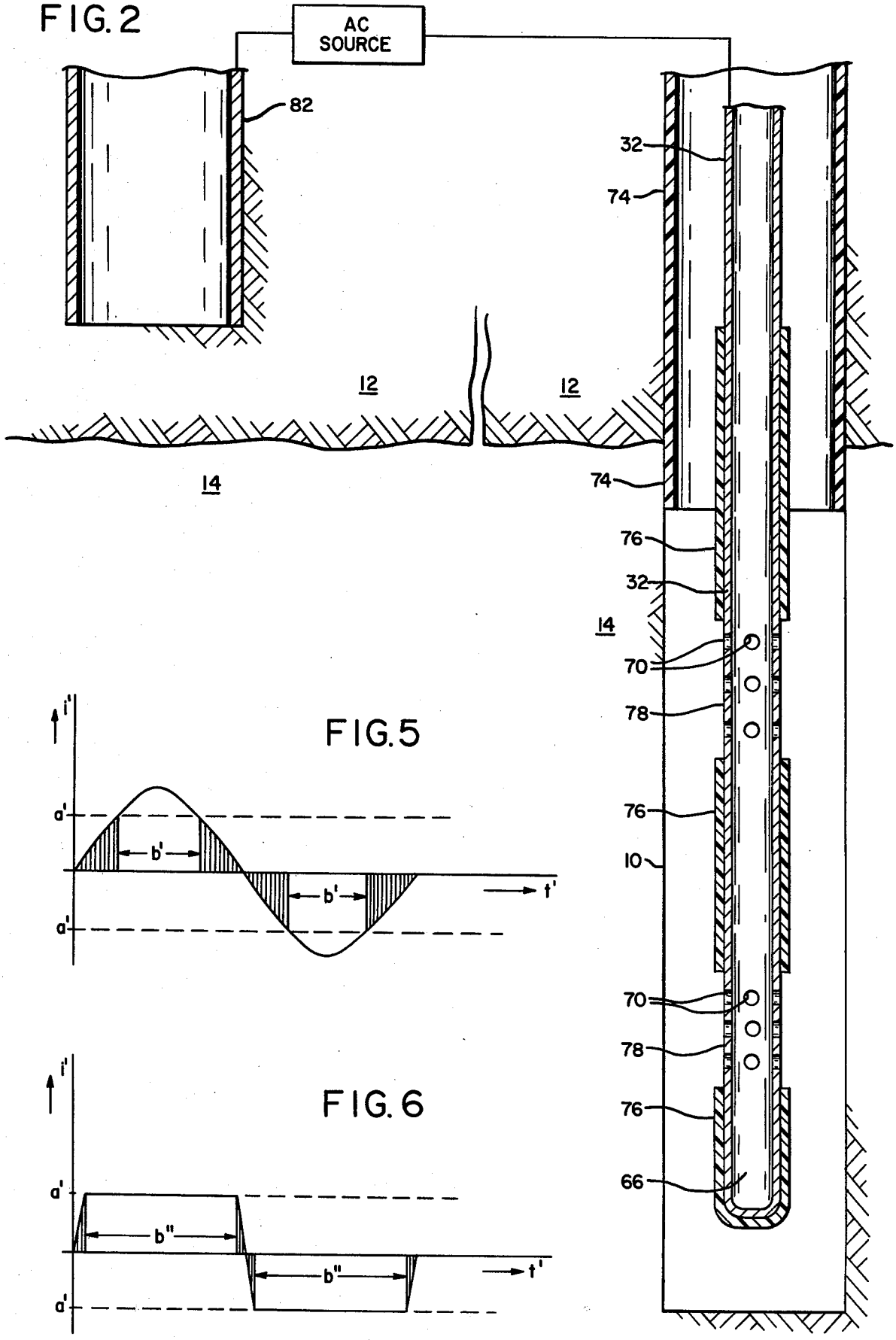
FIG. 2 is a diagrammatic view showing a partial sectional view of a second embodiment of the invention electrically connected to an adjacent well casing.
FIG. 5 is a graphic illustration of alternating current having a sinusoidal wave form.
FIG. 6 is a comparative graphic illustration of alternating current having a substantially rectangular wave form.

As has been previously pointed out, sufficient current density is a precipitating factor of the exothermic electrochemical reaction. However, as shown in FIG. 5, conventional alternating current has a sinusoidal wave form which may keep the current density amplitude below the threshold amplitude necessary to stimulate the reaction for a significant portion of the cycle. Referring to FIG. 5, the vertical axis of the graph represents current density amplitude i' while the horizontal axis represents time t'. For illustrative purposes, assuming a threshold amplitude a' necessary to stimulate the reaction, the duty cycle b' of the current wave is significantly smaller than the total time of the current wave. Although resistive heating will take place during the nonduty cycle periods represented by the shaded areas under the curve, this resistive heating is much less efficient in terms of energy released per unit of electrical power supplied than the exothermic electrochemical reaction, and does not pressurize the formation, break the oil out of its formation matrix or create any hot gases to distribute the heat throughout the formation.

Referring now to FIG. 6, alternating current having a substantially rectangular waveform is superimposed on the same axes as described in FIG. 5. With the same current density threshold amplitude a' it can readily be seen that the duty cycle b'' is significantly larger for the same time period than the duty cycle b' of the sinusoidal wave. While additional electric power is necessary to achieve the rectangular waveform, the total electric power is more efficiently used to stimulate the desired electrochemical reaction.

Returning to the practice of the invention, after the exothermic electrochemical reaction is initiated, the electrical current may be reduced to that level which will sustain the reaction so that the formation immediately next to the electrode does not pressurize too rapidly. The reaction is allowed to continue for a desired time interval, building heat and pressure in the formation, thinning the oil and breaking it out of its formation matrix. The desired time interval may be dictated by the maximum allowable formation pressure as determined by industry regulation, may be determined by a desirable formation pressure at the electrode well or an adjacent well, or may be established by trial and error by determining whether there is sufficient formation pressure to produce oil through the discharge valve 54 at the desired flow rate. The electric current is then interrupted (or at least decreased) and the intense heat near the electrode is allowed to dissipate out into the formation, cooling the oil proximate the electrode to below the flash point of the oil.

One method of determining whether the temperature of the oil proximate the electrode is below the flash point of oil at atmospheric pressure is to bleed off the head of saltwater in the conductive tubing 32 by opening the discharge valve 54 and taking the temperature of the steam as it escapes. (Since the flash point of oil is well above the boiling point of water at atmospheric pressure, the saltwater head would be discharged as steam.) If the temperature of the steam approaches the flash point of the oil, the discharge valve is closed and the well allowed to cool further.

After this cooling and stabilization period, usually shorter than the reaction period, the salt water and pressure in the conductive tubing are bled off through the discharge valve 54 and, if the formation pressure is sufficienly high and the oil is not too viscous, a small amount of oil for testing purposes may be produced without the aid of a pump. The well is then converted from an electrode well into a producing well and producing equipment, including a pump if necessary, are attached to the wellhead. Periodically the well may be recharged by the described method to increase the formation temperature and pressure sufficiently to economically produce oil from the well.

It may be more efficient to operate at a higher current level than is necessary to sustain the reaction and periodically interrupt the current to allow the extreme heat and pressure which are created near the electrode to dissipate out into the formation. This intermittent current application would result in correspondingly intermittent periods of successive exothermic electrochemical reactions combining to build the desired heat and pressure throughout the formation, after which the formation is allowed to cool and stabilize as previously explained before producing oil therefrom.

Referring now to FIG. 4, an alternative embodiment of the invention is assembled by drilling a bore hole through overlying earth material 12 to the top of the oil-bearing formation 14. The bore hole is lined with a string of conductive casing 16 extending from the surface preferably only to the top of the formation and cemented into place (not shown) as previously described with respect to the embodiment shown in FIG. 1. Then by entering the casing 16 with a drill, an extension bore hole 62 is drilled down into the oil-bearing formation and a string of conductive tubing 32 is run within the conductive casing from the surface down into the oil-bearing formation. Alternatively, the bore hole may be drilled to the bottom of the formation, conductive casing 16 placed within the bore hole from the top of the formation to the surface, and the portion of the bore hole in the formation filled with sand. The casing may then be cemented into place, the sand in the bottom of the bore hole preventing the cement from entering the formation. Thereafter, the sand may be washed out of the bore hole, allowing installation of the electrode in the portion of the bore hole extending into the formation.

A string of nonconductive tubing 36 is run outside of the conductive tubing and inside of the conductive casing from the surface to a point within the oil-bearing formation above the terminus of the conductive tubing, thus insulating the conductive tubing from the conductive casing. The portion of the conductive tubing extending below the nonconductive tubing and electrically exposed to the oil-bearing formation serves as the electrode 64. The electrode preferably has a sump 66 to catch sand particles and a nonconductive coating 68 to limit the size of the electrode as previously explained. Perforations 70 allow saltwater or other aqueous electrolytic liquid to be injected into the formation and allows oil to flow into the conductive tubing during the production phase. As previously described, fuel oil or other nonconductive fluid may also be used to enhance insulation and ensure that the saltwater or other aqueous formation fluid does not rise within the conductive casing; the fuel oil being lighter than the saltwater is trapped between the pressure-injected saltwater and the sealed well head. The leads from an AC power source are electrically connected to the conductive tubing 32 and the conductive casing 16 causing current to flow through the saltwater-infused oil-bearing formation between the electrode 64 and the conductive casing 16 causing the previously described exothermic electrochemical reaction.

The embodiment shown in FIG. 4 may also be used when practicing the invention in oil fields having existing bore holes which are cased with conductive casing. If the conductive casing 16 does not extend substantially into the oil-bearing formation, the existing casing may be entered with a drill and the extension bore hole 62 drilled down into the formation, proceeding as described above. If however, the conductive casing extends too far into the oil-bearing formation to conviently emplace an electrode therein, it is preferable to enter the casing with a cutting tool and mill out the conductive casing which extends down into the oil-bearing formation to enable the operation to proceed as previously described. It is not crucial that the conductive casing not extend into the oil-bearing formation, variations of the embodiments shown in FIGS. 1 and 4 could have the conductive casing extending into the oil-bearing formation.

Referring to the embodiment shown in FIG. 2, a bore hole 10 is drilled through overlying earth material 12 into the oil-bearing formation 14. The bore hole is lined with a string of nonconductive casing 74 extending from the surface down to the oil-bearing formation. A string of conductive tubing 32 is run inside the nonconductive casing from the surface down into the oil-bearing formation. Insulating sleeves 76 selectively cover portions of the conductive tubing 32 which extend below the nonconductive casing into the oil-bearing formation, the uncovered portions of the conductive tubing 32 in electrical contact with the formation serving as electrodes 78. The upper insulating sleeve 76 preferably extends up into the non-conductive casing 74 and, in cooperation with the fuel oil employed as previously described, prevents saltwater from rising within the nonconductive casing above the insulating sleeve and making electrical contact with the conductive tubing. In common with the previously described embodiments, this embodiment may have a closed sump 66 to catch sand particles which enter the tubing with the oil during the production phase.

As with the other embodiments, salt water is pressure injected into the oil-bearing formation through the perforations 70 in the electrodes 78. An AC power source has one lead connected to the conductive tubing and the other lead connected to an adjacent conductive well casing 82 of an existing well, the adjacent well casing preferably not extending into the oil-bearing formation. Thus electrical current is caused to flow through the saltwater-infused oil-bearing formation proximate the electrodes and the overlying earth material between the electrodes of the electrode well and the adjacent conductive well casing initiating the exothermic electrochemical reaction as previously described, after which oil is produced from the bore hole 10. Since the reaction occurs only in the oil-bearing formation proximate the electrodes, the remoteness of the adjacent well casing 82 is not crucial to practicing the invention. It is preferable, as previously discussed, that the adjacent conductive well casing have a large electrically conducting surface area in electrical contact with earth material so as to minimize the resistance of that portion of the electrical circuit. Since no exothermic electrochemical reaction can occur in the earth material, and resistive heating proximate the adjacent conductive well casing would have no beneficial effect, voltage drop due to energy production at this portion of the circuit is to be avoided.

It should be pointed out that the number of electrodes 78 in electrical contact with the oil-bearing formation is optional, as long as each electrode area and the aggregate electrode area in contact with the oil-bearing formation is sufficiently small with respect to the current to achieve the threshold current density at each electrode. For example, it may be useful to use a plurality of small electrodes as shown in FIG. 2 if the oil-bearing formation is extremely thick.

It should also be noted that any large conductor in electrical contact with earth material would be satisfactory, the conductive well casing of adjacent wells being merely convenient in existing oil fields.

Figure 3:
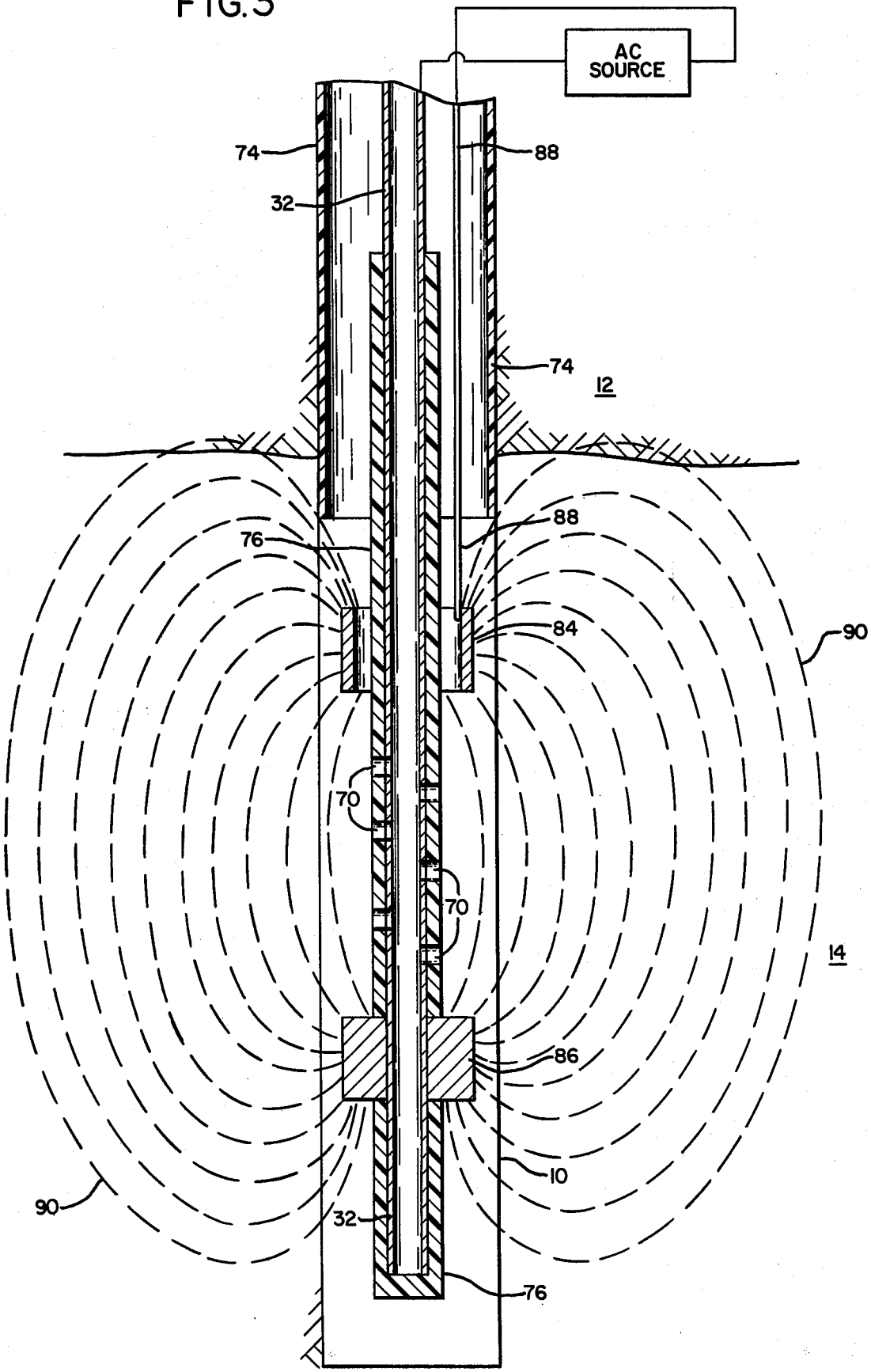
FIG. 3 is a partially schematic sectional view of a third embodiment of the invention.

Referring now to FIG. 3, another embodiment of the invention is assembled by drilling a bore hole 10 through overlying earth material 12 and into an oil-bearing formation 14. A string of nonconductive casing 74 is placed within the bore hole extending down to the top of the oil-bearing formation and a string of conductive tubing 32 is run within the nonconductive casing 74 extending well down into the oil-bearing formation. An insulating sleeve 76 is placed around the portion of the conductive tubing which extends below the nonconductive casing, the sleeve extending up within the nonconductive casing above the top of the oil-bearing formation. As previously explained, fuel oil may be used to enhance insulation and prevent saltwater from rising within the casing.

Two spaced-apart electrodes are supportably located in the oil-bearing formation by the string of conductive tubing and insulating sleeve, the first electrode 84 being insulated from the conductive tubing by the insulating sleeve and in electrical contact with an insulated wire 88 or other insulated conductor extending to the surface, and the second electrode 86 being in electrical contact with the conductive tubing. As in the other embodiments, saltwater is pressure injected into the formation through the conductive tubing and out perforations 70 located between the spaced-apart electrodes in the conductive tubing and the insulating sleeve. An AC power source is electrically connected beween the insulated wire 88 and the conductive tubing 32 causing current to flow through the saltwater-infused oil-bearing formation between the two electrodes, initiating a region of exothermic electrochemical reaction proximate each electrode. It is preferable that the electrodes be sufficiently spaced apart within the formation so that the electrical current path, represented by the electrical field 90, spreads out into the formation rather than merely passing through the saltwater-filled bore hole 10. Since the cross-sectional area of the current path is smallest immediately next to the electrodes, the resistance, and hence the energy production due to resistive heating is also greatest at this point, the conductive tubing and insulated wire 88 providing minimal resistance in the overall circuit. Thus the requisite heat and current density for the reaction can be achieved at each electrode by regulating the size of the electrode. This embodiment is also particularly suited to a thick oil-bearing formation.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for enhancing oil production from a subsurface oil-bearing formation containing an aqueous electrolytic liquid therein comprising the steps of:

(a) placing a first electrical conductor in electrical contact with said aqueous liquid in said oil-bearing formation through a bore hole which extends through earth material into said oil-bearing formation, and substantially electrically insulating said first electrical conductor from earth material other than said oil-bearing formation surrounding said bore hole;

(b) extending a second electrical conductor through earth material and establishing an electrical path between said first and second electrical conductors respectively;

(c) during a first time interval, establishing an electrical current between said first and second electrical conductors sufficient to create an exothermic electrochemical reaction, proximate said first electrical conductor, between said aqueous electrolytic liquid and oil present in said oil-bearing formation, and increasing the temperature and pressure in said oil-bearing formation proximate said first electrical conductor by means of said reaction;

(d) thereafter discontinuing the creation of said exothermic electrochemical reaction; and (e) producing oil from said oil-bearing formation through said bore hole after the expiration of a second time interval following step (d), said second time interval being less than said first time interval.

2. The method of claim 1 wherein step (c) includes increasing the temperature in said oil-bearing formation proximate said first electrical conductor to a temperature above the flash point of the oil therein, said second time interval being great enough to permit the reduction of said temperature to a temperature below said flash point.

3. The method of claim 1 or 2 wherein step (c) includes sealing said oil-bearing formation from communication with atmospheric pressure through said bore hole.

4. The method of claim 1 wherein step (c) includes establishing said electrical current sufficient to maintain a continuous exothermic electrochemical reaction.

5. The method of claim 4 wherein step (d) includes reducing said electrical current below the level required to maintain said continuous exothermic electrochemical reaction.

6. The method of claim 4 wherein step (d) includes interrupting said electrical current.

7. The method of claim 1 wherein step (c) includes establishing an intermittent electrical current sufficient to create intermittent successive exothermic electrochemical reactions.

8. The method of claim 1 wherein step (b) includes placing said second electrical conductor in electrical contact with earth material other than said oil-bearing formation while preventing said second electrical conductor from extending into said oil-bearing formation.

9. The method of claim 8 wherein step (b) further includes extending said second electrical conductor through said bore hole.

10. The method of claim 1, 8 or 9 wherein said first electrical conductor has a first electrically conducting surface area in contact with said aqueous electrolytic liquid and said second electrical conductor has a second electrically conducting surface area, greater than said first electrically conducting surface area, in contact with earth material so as to establish an electrical current density proximate said first electrical conductor which is greater than the electrical density proximate said second electrical conductor.

11. The method of claim 10 wherein said second electrically conducting surface area in electrical contact with said earth material is sufficiently large to provide a desired minimum resistance to said electrical current in earth material proximate said second electrically conducting surface area which is less than the resistance to said electrical current in said oil-bearing formation proximate said first electrically conductive surface area.

12. The method of claim 1 wherein said electrical current comprises alternating current having a substantially rectangular waveform.

13. A method for enhancing oil production from a subsurface oil-bearing formation containing an aqueous electrolytic liquid therein comprising the steps of:

(a) placing a first electrical conductor having a first electrically conducting surface area in electrical contact with said aqueous electrolytic liquid in said oil-bearing formation through a bore hole which extends through earth material into said oil-bearing formation, and electrically insulating said first electrical conductor substantially from earth material other than said oil-bearing formation surrounding said bore hole;

(b) extending a second electrical conductor through said bore hole and establishing an electrical path through said oil-bearing formation between said first and second electrical conductors respectively;

(c) establishing an electrical current between said first and second electrical conductors, said first electrically conducting surface area being sufficiently small with respect to said current to produce a current density proximate said first electrically conducting surface area sufficient to cause an exothermic electrochemical reaction, proximate said first electrically conducting surface area, between said aqueous electrolytic liquid and oil present in said oil-bearing formation, and increasing the temperature and pressure in said oil-bearing formation proximate said first electrically conducting surface area by means of said reaction; and (d) thereafter producing oil from said oil-bearing formation proximate said bore hole.

14. The method of claim 13 wherein step (d) includes producing oil from said bore hole.

15. The method of claim 13 wherein said electrical current comprises alternating current having a substantially rectangular waveform.

16. The method of claim 13 wherein said second electrical conductor comprises an exterior casing of a portion of said bore hole located above said oil-bearing formation.

17. The method of claim 13 wherein said second electrical conductor has a second electrically conducting surface area, in electrical contact with earth material, which is greater than said first electrically conducting surface area so as to establish an electrical current density proximate said first electrically conducting surface area which is greater than the electrical current density proximate said second electrically conducting surface area.

18. The method of claim 17 wherein said second electrically conducting surface area in electrical contact with said earth material is sufficiently large to provide a desired minimum resistance to said electrical current in earth material proximate said second electrically conducting surface area which is less than the resistance to said electrical current in said oil-bearing formation proximate said first electrically conductive surface area.

19. The method of claim 13 wherein step (c) includes sealing said oil-bearing formation from communication with the atmosphere through said bore hole.

20. The method of claim 13 including producing thermal energy in said aqueous electrolytic liquid proximate said first electrically conducting surface area due to the electrical resistance of said aqueous electrolytic liquid to said electrical current.

21. The method of claim 20 wherein said thermal energy caused by said electrical current proximate said first electrically conducting surface area due to the electrical resistance of said aqueous electrolytic liquid is less than the thermal energy caused by said exothermic electrochemical reaction proximate said first electrically conducting surface area.

22. A method for enhancing oil production from a subsurface oil-bearing formation containing an aqueous electrolytic liquid therein comprising the steps of:

(a) placing a first electrical conductor in electrical contact with said aqueous electrolytic liquid in said oil-bearing formation through a bore hole which extends through earth material into said oil-bearing formation;

(b) placing a second electrical conductor in electrical contact with said aqueous electrolytic liquid in said oil-bearing formation through said bore hole, said second electrical conductor being electrically insulated in said bore hole from said first electrical conductor and spaced from said first electrical conductor in said formation;

(c) placing a string of electrically nonconductive casing in said bore hole separating earth material other than said oil-bearing formation from said first and second electrical conductors; and (d) establishing an electrical current between said first and said second electrical conductors through said oil-bearing formation sufficient to cause an exothermic electrochemical reaction between said aqueous electrolytic liquid and oil present in said oil-bearing formation, and increasing the temperature and pressure in said oil-bearing formation by means of said reaction; and (e) thereafter producing oil from said oil-bearing formation proximate said bore hole.

23. The method of claim 22 wherein step (e) includes producing oil from said bore hole.

24. The method of claim 22 wherein said first electrical conductor has a first electrically conducting surface area exposed to said formation which is sufficiently small with respect to said current to produce a current density proximate said first electrically conducting surface area sufficient to cause said exothermic electrochemical reaction between said aqueous electrolytic liquid and said oil.

25. The method of claim 22 wherein said second electrical conductor has a second electrically conducting surface area exposed to said formation which is sufficiently small with respect to said current to produce a current density proximate said second electrically conducting surface area sufficient to cause said exothermic electrochemical reaction between said aqueous electrolytic liquid and said oil.

26. The method of claim 22 wherein said one of said first or second electrical conductors comprises a string of conductive tubing.

27. The method of claim 22 wherein said electrical current comprises alternating current having a substantially rectangular waveform.

28. A method for enhancing oil production from a subsurface oil-bearing formation containing an aqueous electrolytic liquid therein comprising the steps of:

(a) placing a first electrical conductor having a first electrically conducting surface area in electrical contact with said aqueous electrolytic liquid in said oil-bearing formation through a bore hole which extends through earth material into said oil-bearing formation;

(b) positioning a string of electrically nonconductive casing in said bore hole interposed between said earth material other than said oil-bearing formation and said first electrical conductor;

(c) placing a second electrical conductor having an electrically conducting surface area in electrical contact with earth material; and (d) establishing an electrical current between said first and second electrical conductors sufficient to cause an exothermic electrochemical reaction, proximate said first electrically conducting surface area, between said aqueous electrolytic liquid and oil present in said oil-bearing formation, and increasing the temperature and pressure in said oil-bearing formation by means of said reaction; and (e) thereafter producing oil from said oil-bearing formation through said bore hole.

29. The method of claim 28 wherein said first electrically conducting surface area in electrical contact with said oil-bearing formation is sufficiently small with respect to said current to produce a current density proximate said first electrically conducting surface area sufficient to cause said exothermic electrochemical reaction between said aqueous electrolytic liquid and said oil.

30. The method of claim 28 wherein said second electrically conducting surface area is larger than said first electrically conducting surface area.

31. The method of claim 28 wherein said second electrically conducting surface area in electrical contact with said earth material is sufficiently large to provide a desired minimum resistance to said electrical current in earth material proximate said second electrically conducting surface area which is less than the resistance to said electrical current in said oil-bearing formation proximate said first electrically conducting surface area.

32. The method of claim 28 wherein said first electrical conductor comprises a string of conductive tubing.

33. The method of claim 28 wherein said second electrical conductor comprises an electrically conductive casing of a second bore hole remote from said bore hole.

34. The method of claim 28 wherein said electrical current comprises alternating current having a substantially rectangular waveform.

35. A method for enhancing oil production from a subsurface oil-bearing formation containing an aqueous electrolytic liquid therein comprising the steps of:

(a) placing an electrical conductor in electrical contact with said aqueous electrolytic liquid in said oil-bearing formation through a bore hole which extends through earth material into said oil-bearing formation, and electrically insulating said first electrical conductor substantially from earth material other than said oil-bearing formation surrounding said bore hole;

(b) passing an alternating electrical current having a substantially rectangular waveform from said electrical conductor into said oil-bearing formation, said alternating electrical current being sufficient to cause an exothermic electro-chemical reaction, proximate said electrical conductor, between said aqueous electrolytic liquid and oil present in said oil-bearing formation, and increasing the temperature and pressure in said oil-bearing formation proximate said first electrical conductor by means of said reaction; and (c) thereafter producing oil from said oil-bearing formation through said bore hole.

* * * * *

UNITED STATES PATENT AND TRADEMARK OFFICE

CERTIFICATE OF CORRECTION

PATENT NO. : 4,463,805

DATED : August 7, 1984

INVENTOR(S) : Clark Bingham

It is certified that error appears in the above-identified patent and that said Letters Patent is hereby corrected as shown below:

| | | |
|---|---|---|
| Col. 4, | Line 61 | Change "wall" to --well-- |
| Col. 7, | Line 60 | After "aforementioned" insert --beneficial-- |
| Col. 8, | Line 39 | Change "to" to --or-- |
| Col. 9, | Line 40 | Change "sufficienly" to --sufficiently-- |
| Col. 13, | Line 46 | After "electrical" insert --current-- |

Signed and Sealed this

*Twenty-second* Day of *July 1986*

[SEAL]

*Attest:*

DONALD J. QUIGG

*Attesting Officer*

*Commissioner of Patents and Trademarks*